US005939830A

United States Patent [19]

Praiswater

[11] Patent Number: 5,939,830

[45] Date of Patent: Aug. 17, 1999

[54] METHOD AND APPARATUS FOR DIMMING A LAMP IN A BACKLIGHT OF A LIQUID CRYSTAL DISPLAY

[75] Inventor: Michael R. Praiswater, Albuquerque, N.Mex.

[73] Assignee: Honeywell Inc., Minneapolis, Minn.

[21] Appl. No.: 08/998,110

[22] Filed: Dec. 24, 1997

[51] Int. Cl.[6] ..... H05B 37/02

[52] U.S. Cl. ..... 315/DIG. 4; 315/209 R; 315/219

[58] Field of Search ..... 315/169.3, 209 R, 315/219, 291, 224, 306, 307, 308, 283, DIG. 5, DIG. 4

[56] References Cited

U.S. PATENT DOCUMENTS 4,482,844 11/1984 Schweer et al. ..... 315/194
4,998,045 3/1991 Ruby et al. ..... 315/209
5,027,034 6/1991 Ruby et al. ..... 315/106
5,105,127 4/1992 Lavaud et al. ..... 315/291
5,428,265 6/1995 Booth, Jr. et al. ..... 315/158
5,491,387 2/1996 Saito ..... 315/307

*Primary Examiner*—Don Wong
*Assistant Examiner*—David H. Vu
*Attorney, Agent, or Firm*—Andrew A. Abeyta

[57] ABSTRACT

A method and apparatus for dimming a lamp in a backlight system of a display device, e.g., liquid crystal display ("LCD"), with a brightness dimming ratio of 10,000:1, which is a factor of 10 better than conventional dimming devices. A switch is provided in an inverter circuit, which has reactive components, that drives the lamp. The is positioned in the inverter circuit such that, when it is closed, the energy stored within the reactive components of the inverter circuit is discharged to ground. In one embodiment, the signals from the power supply are pulse width modulated.

16 Claims, 8 Drawing Sheets

METHOD AND APPARATUS FOR DIMMING A LAMP IN A BACKLIGHT OF A LIQUID CRYSTAL DISPLAY

I. CROSS-REFERENCE TO RELATED APPLICATIONS

Not applicable.

II. BACKGROUND OF THE INVENTION

The present invention relates generally to the field of display devices. More specifically, the present invention relates generally to dimming methods and apparatuses for lamps used in backlighting systems for display devices, such as liquid crystal display ("LCD") devices.

LCD devices are used widely in many applications, including, for example, aircraft instrument display systems. An LCD device includes a liquid crystal panel selectively made opaque in certain regions in order to generate images, icons, and characters in an instrument display in response to, for example, a video signal. To further enhance the visibility of such images of the liquid crystal panel, LCD devices require a backlight, i.e., a light source positioned on the backside of the liquid crystal panel. In recent years, LCDs with backlights have been incorporated into the cockpits of all types of aircraft. The aircraft cockpit can be one of the most extreme environments in which a fluorescent lamp must operate. As applied to aircraft instrument display systems, especially in military aircraft display systems, it is important that the LCD device have the functionality to dim the luminance of the LCD panel.

One aspect of the cockpit environment which affects the backlight system is the large dimming range. These LCDs require a backlighting system to make information visible to the pilot under lighting conditions that can range from near blackness at night to direct sunlight on the LCD during the day. As such, an LCD that operates in this environment must have an extremely-high dimming ratio. Because it is also desired that the backlighting color not change over the dimming range, fluorescent lamps are preferred because their color is not altered by dimming but rather by the selection of the appropriate composition of phosphorous coating within the lamps. Accordingly, the brightness of the fluorescent lamp needs to vary by large amount in order for the pilot to be able to view the LCD under all lighting conditions. The system should be free of swirls, flicker, and discontinuities and be capable of withstanding temperatures from—55° C. to 85° C. with a smooth response to the pilot's dimming command and be able to provide a large number of cold starts and hours of operation while maintaining a high-efficiency circuit.

One scheme for dimming a fluorescent lamp is a system in which the alternating signal that is supplying power to the lamp is cut with a notch of variable width so as to reduce the power applied to the lamp and thereby provide the desired dimming. The smaller the widths of AC power provided to the lamp, the lower the luminance at which the lamp operates. A common device for providing the ability to vary the width of the pulses are commercially-available pulse-width modulators ("PWM").

A PWM is a device that causes pulse-time modulation (modulation in which the value of instantaneous samples of the modulating wave are caused to modulate the time of occurrence of some characteristic of a pulse carrier) in which the value of each instantaneous sample of the modulating wave is caused to modulate the duration of a pulse. The modulating frequency can be fixed or variable. The basic operation of these PWMs is as follows. A reference voltage is transmitted to the PWM. The magnitude of the reference voltage is proportional to the desired width of the pulses.

The present invention is a dimming device that dims the fluorescent lamp of a backlight of an LCD device. The present invention provides a factor of ten improvement over conventional dimming devices without increasing the cost of such a dimming device by any significant amount.

III. BRIEF SUMMARY OF THE INVENTION

The following summary of the invention is provided to facilitate an understanding of some of the innovative features unique to the present invention, and is not intended to be a full description. A full appreciation of the various aspects of the invention can only be gained by taking the entire specification, claims, drawings, and abstract as a whole.

In one embodiment, the present invention comprises an apparatus for dimming the brightness of a lamp, such as that used for a backlight of a liquid crystal display ("LCD"), the apparatus comprising a power supply that supplies direct-current power, the power supply being referenced to ground; and an inverter, operatively connected to said power supply, for receiving the direct-current power and converting it to alternating-current power to drive the lamp. The inverter comprises first switching means for creating alternating-current power; power conversion means, operatively connected to said first switching means, for providing and maintaining an arc voltage across the lamp; modulating means, operatively connected to said power conversion means, for modulating the alternating-current power to control and vary the alternating-current power across the lamp between zero volts and the arc voltage; a plurality of reactive components operatively connected to the power conversion means, said plurality of reactive components storing energy provided by said power supply; and second switching means, operatively connected to said plurality of reactive components, for switching the lamp between an on and an off state, said second switching means being positioned in the inverter such that energy stored in said plurality of reactive components is discharged to ground when switched to the off state.

Additionally, the present invention comprises a method of dimming the brightness of at least one lamp, the method including the steps of: providing a power supply that supplies direct-current power, the power supply being referenced to ground; and providing an inverter to receive the direct-current power and convert it to alternating-current power to drive the lamp. The inverter circuit includes reactive components that store energy provided by the power supply. The step of providing an inverter includes the steps of converting the direct-current power to alternating-current power; providing and maintaining an arc voltage across the lamp; modulating the alternating-current power to control and vary the alternating-current power across the lamp between zero volts and the arc voltage; switching the lamp between an on and an off state through the use of switching means that are positioned in the inverter such that energy stored in the reactive components is discharged to ground when the switching means are switched to the off state.

In another embodiment, the present invention is an apparatus for dimming the brightness of a lamp, the apparatus including a power supply that supplies direct-current power, the power supply being referenced to ground; and an inverter, operatively connectable to the power supply, for driving the lamp. The inverter comprises switching means for creating alternating-current power from the direct-current power and for switching the lamp between an on and an off state; power conversion means, operatively connectable to the switching means, for providing and maintaining an arc voltage across the lamp; modulating means, operatively connectable to the power conversion means, for modulating the alternating-current power to vary the alternating-current power across the lamp between zero volts and the arc voltage; and a plurality of reactive components operatively connectable to the power conversion means, the reactive components storing energy provided by the power supply; and wherein the switching means is located in the inverter such that energy stored in the plurality of reactive components is discharged to ground when the lamp is switched to the off state.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow.

IV. BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

V. DETAILED DESCRIPTION OF THE INVENTION

The following discussion describes an individual LCD system, but it will be understood that the discussion applies to a plurality of LCD systems that use lamps in a backlight device. Additionally, the following discussion of FIGS. 1–4 relates to a conventional dimming circuit, but is presented before discussing the present invention in order to facilitate the discussion of the present invention.

Generally, an LCD system includes, as relevant to the present invention, a dimming control circuit (e.g., FIGS. 1 and 5) for suitably driving the fluorescent lamps within the backlight of the LCD system. A pilot, or other viewer of an LCD, typically controls the luminance of an LCD by adjusting a control either on the particular LCD itself or on an interface on the cockpit instrument panel. In many LCD applications, it is necessary to have the LCD lighting change due to, for example, changes in the ambient conditions around the LCD. As the exterior lighting gets brighter, so should the backlight and vice-versa. Accordingly, each LCD system receives a pilot command intensity adjustment representing a pilot selected or automated modification relative to the overall LCD brightness. A signal from the intensity adjustment device is transmitted to the pulse width modulator 120. The signal from the intensity adjustment device is at a level that is proportional to the desired intensity of the backlight. The pulse width modulator 120 converts this input signal into a pulse having a width that is proportional to the desired intensity of the backlight. These periodic pulses are transmitted to inverter 100 which outputs a signal of sufficient amplitude in order to drive the backlight at the desired intensity.

Figure 1:
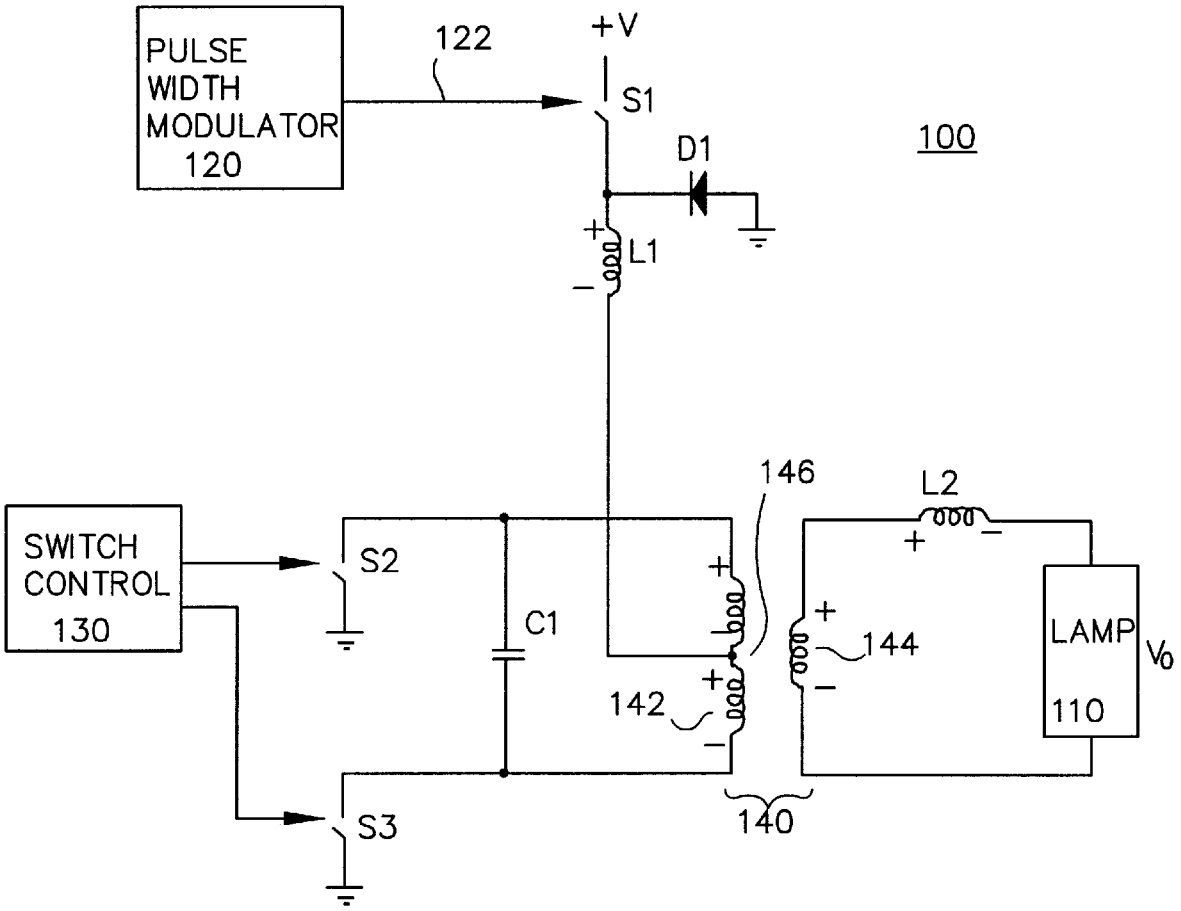
Fig.1 (PRIOR ART)
FIG. 1 (prior art) is a simplified schematic diagram of a conventional current-fed resonant lamp inverter 100.

Referring to FIG. 1, there is shown such a conventional current-fed resonant lamp inverter 100. The DC power supply +V (typically between 3V and 30V) is applied to the inverter via the switch S1. A negative power supply can be used provided that other design changes are made to the inverter circuit in a manner well known to those skilled in the art. Switch S1 is operatively connected between the positive power supply +V and inductor L1. Inductor L1 is operatively connected to the center tap 146 of transformer 140. Also, a diode D1 is operatively connected at a first node between switch S1 and inductor L1 and at a second node to ground. Switch S1 can be any switch that is commercially available, such as an analog switch, transistor, etc. A pulse-width modulator ("PWM") 120 is operatively connected to switch S1. A capacitor C1 is connected in parallel with transformer 140. A first node of capacitor C1 is operatively connected to switch S2, and a second node of capacitor C1 is operatively connected to switch S3. Switches S2 and S3 are also operatively connected to ground. Switches S2 and S3 are operatively connected with switch controller 130. A ballast inductor L2 is operatively connected in series with the load or lamp 110, such as a fluorescent lamp, and with the secondary windings 144 of transformer 140.

When switch S1 is closed (on), DC power is applied to the inverter 100, and a AC voltage, e.g., sinusoidal voltage, appears across the load or lamp 110. Current flows from power supply +V to the centertap 146 of the transformer 140 through inductor L1. The switch controller 130 controls the two states (i.e., on or off) of switches S2 and S3. Switches S2 and S3 are opened and closed in an alternating fashion thereby creating an AC waveform across the primary windings 142 of the transformer 140, which increases the voltage to drive the lamp 110. The frequency of operation of switches S2 and S3 can be fixed but is normally synchronous with the resonant frequency of the reactive components in the circuit (e.g., C1, L2, transformer). When switches S2 and S3 are synchronized with resonant frequency of the reactive components in the circuit, a sine wave is produced on the output. The desired frequency of operation for S2 and S3 is in the tens of kilohertz. The voltage produced across the primary windings 142 of the transformer 140 is amplified by the transformer turns ratio and an amplified voltage appears across the secondary windings 144 of the transformer 140. The secondary voltage obtained across the secondary windings 144 must exceed the strike voltage of the lamp 110. The strike voltage of the lamp 110 depends on several lamp parameters, including, but not limited to, length, diameter, and fill pressure. When the voltage across the secondary windings 144 exceeds the strike voltage of the lamp 110, current flows through the lamp 110 to turn it on. The lamp current is limited to the proper level by inductor L2. When switch S1 is turned off, power is removed from the inverter circuit to turn the lamp off. However, current continues to flow from the power supply +V return into the transformer centertap 146 through inductor L1 and diode D1 for a short time, until the energy stored in inductor L1 is discharged. When switch S1 is pulse-width modulated by output 122 of PWM 120, the power applied to lamp 110 is controlled, and the luminance of the lamp 110 can be varied (dimmed or brightened) according to input from the operator of the LCD device (not shown).

In another example of conventional dimming circuits, switch S1 is turned on, and power is removed from the circuit to turn off the lamp by turning switches S2 and S3 off at the same time.

Figure 2:
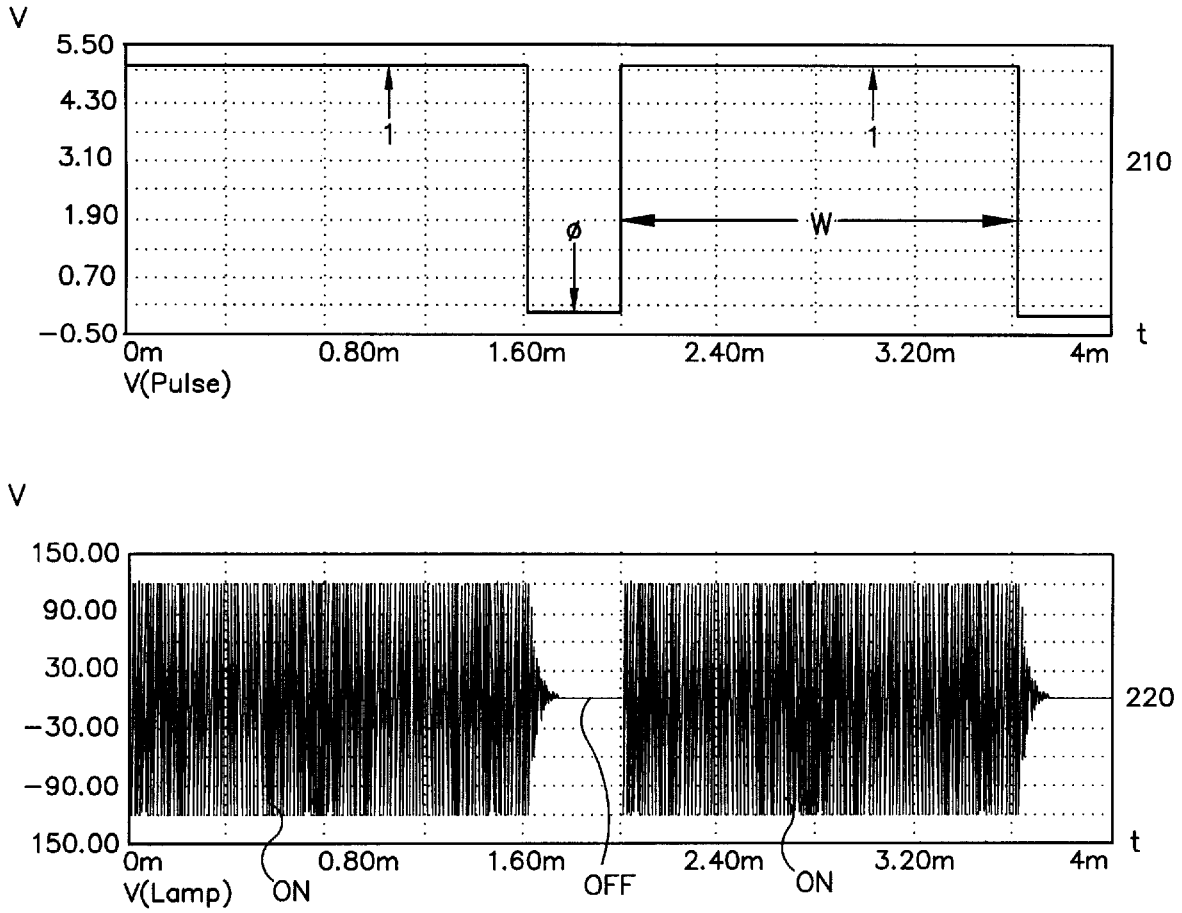
Fig.2 (PRIOR ART)
FIG. 2 (prior art) is a graph of the outputs of the pulse-width modulator and the inverter 100 of FIG. 1 operating at 80% duty cycle, voltage versus time (in milliseconds).

Referring to FIG. 2, there is shown an exemplary graph of the outputs of the PWM 120 and the inverter 100 with voltage versus time (in milli-seconds). The waveforms 210 and 220 were generated using the pulse-width modulated dimming inverter 100. The PWM 120 was operating at an 80% duty cycle driving the lamp 110 to 80% of the maximum luminance. To appear flicker free, the lamp 110 should be modulated at a frequency greater than approximately 8-Hz, for example, 120-Hz. The upper trace 210 is the PWM 120 output 122, and the lower trace 220 is the inverter 100 output $V_O$ measured across the lamp 110. The pulse width w is decreased to dim the lamp 110 and increased to brighten the lamp 110. The luminance of the lamp 100 is approximately proportional to the duty cycle of the PWM 120. The relationship changes at a very low duty cycle (e.g., 50-$\mu$s is an example of very low duty cycle for a particular hot cathode fluorescent lamp) because lamp impedance increases when the lamp is dim. The dimming accelerates at very low duty cycle because of this phenomenon. When the PWM 120 output is a logic 1, the inverter 100 is active so that the lamp 110 produces light. When the PWM 120 output is a logic 0, the inverter 100 is not active so that the lamp 110 does not produce light. However, as can be seen from lower trace 220 and discussed in more detail with reference to FIG. 4 below, there is some oscillation around zero volts and light continues to produced by the lamp 100 until the energy is finally dissipated (reaches zero volts).

Figure 3:
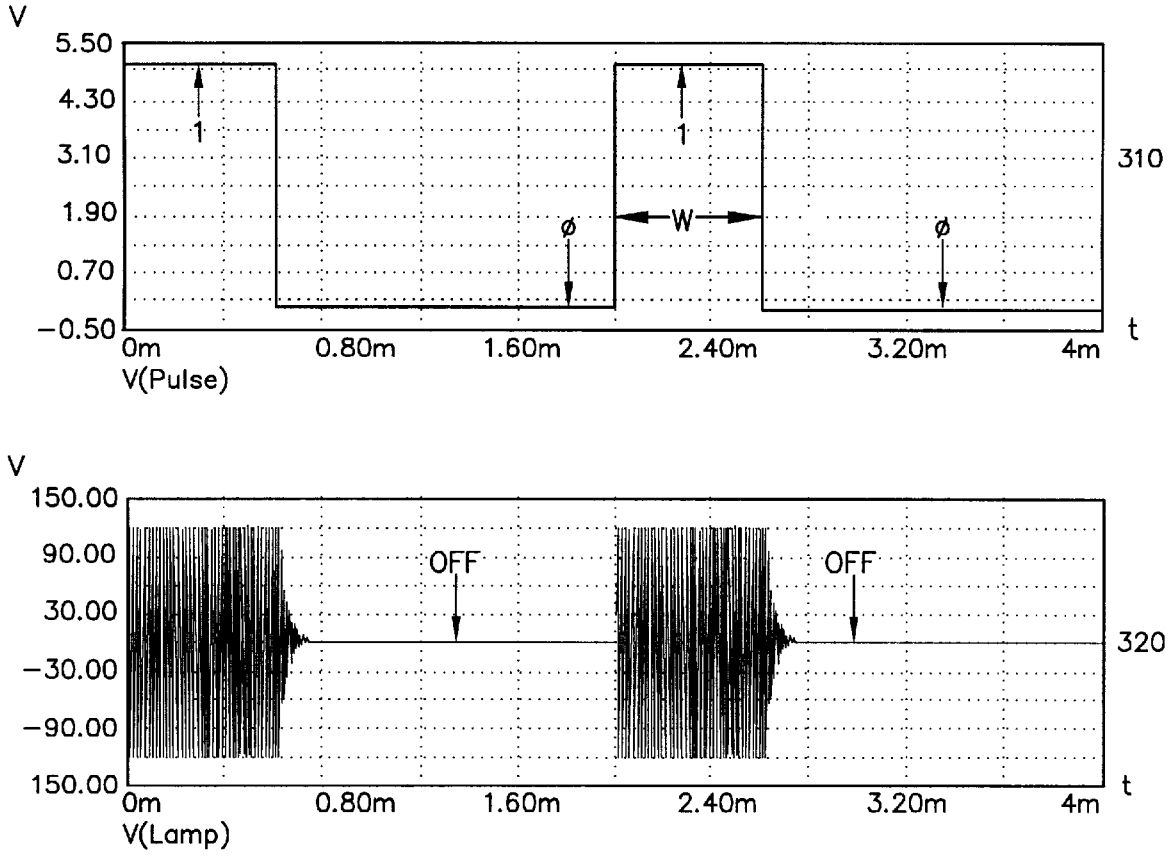
Fig. 3 (PRIOR ART)
FIG. 3 (prior art) is a graph of the outputs of the pulse-width modulator and the inverter 100 of FIG. 1 operating at 30% duty cycle, voltage versus time (in milliseconds).

Referring to FIG. 3, there is shown another exemplary graph of the outputs of the PWM 120 and the inverter 100 with voltage versus time in milli-seconds. The waveforms 310 and 320 were generated using the pulse-width modulated dimming inverter 100. The PWM 120 was operating at an 30% duty cycle driving the lamp 110 to 30% of the maximum luminance. The upper trace 310 is the PWM 120 output, and the lower trace 320 is the inverter output taken across the lamp 110. When the PWM 120 output is a logic 1, the inverter is active, and the lamp 110 produces light. When the PWM 120 output is a logic 0, the inverter is not active, and the lamp 110 does not produce light. However, similar to the case presented in FIG. 3, lower trace 220 demonstrates that there is some oscillation around zero volts and light continues to produced by the lamp 110 until the energy is finally dissipated (reaches zero volts).

Figure 4:
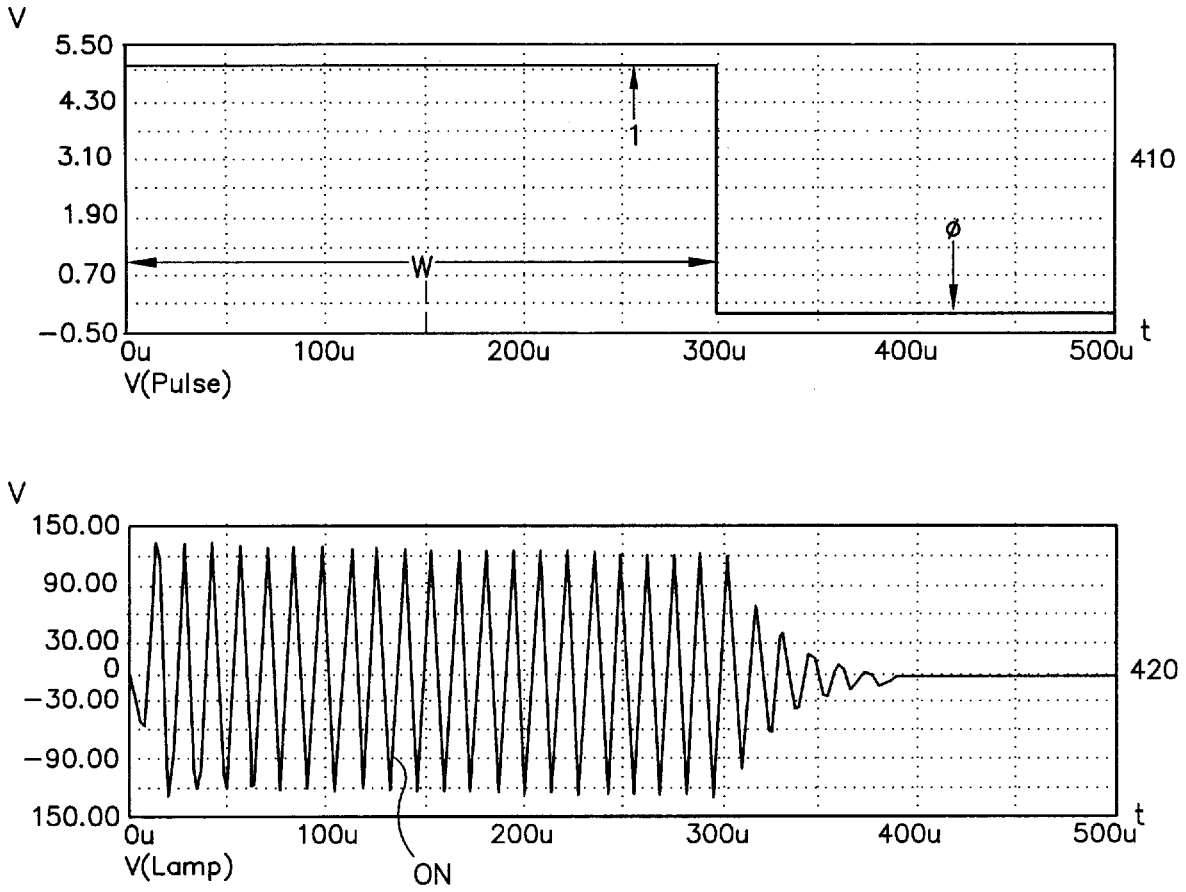
Fig. 4 (PRIOR ART)
FIG. 4 (prior art) is a graph of the turn-off characteristics of the inverter 100 of FIG. 1, voltage versus time (in micro-seconds).

Referring to FIG. 4, there is shown an exemplary graph of the turn-off characteristics of the inverter 100 with voltage versus time in micro-seconds (an expanded scale of the inverter output $V_O$ to demonstrate the problem with inverter 100 oscillating around zero volts after turn off). FIG. 4 provides a closer examination of the turn-off characteristic of the inverter 100. The upper trace 410 is the PWM 120 output, and the lower trace 420 is the inverter output $V_O$ taken across the lamp 110. When power is removed from the inverter 100 by opening switch S1 (off), the output voltage $V_O$ does not fall to zero volts immediately as can be seen from FIG. 4; it oscillates around zero volts for a period of time until zero volts is ultimately obtained. The oscillation is due to the fact that the reactive components in inverter 100 store energy, which discharge into the lamp 110 for a short time after power is removed. The lamp 110 continues to produce light (discharge energy) until the stored energy is drained from the reactive components (e.g., inductor L2), which becomes a problem when a very low luminance is desired such as at night time. At very low luminance, when, for example, only one cycle or half cycle is desired on the inverter output $V_O$, the energy stored in the inverter 100 becomes a high percentage of the power applied to the lamp 110. The turn-off characteristic, as exemplarily shown in FIG. 4, of the inverter 100 limits the dimming ratio to approximately 1000:1.

Figure 5:
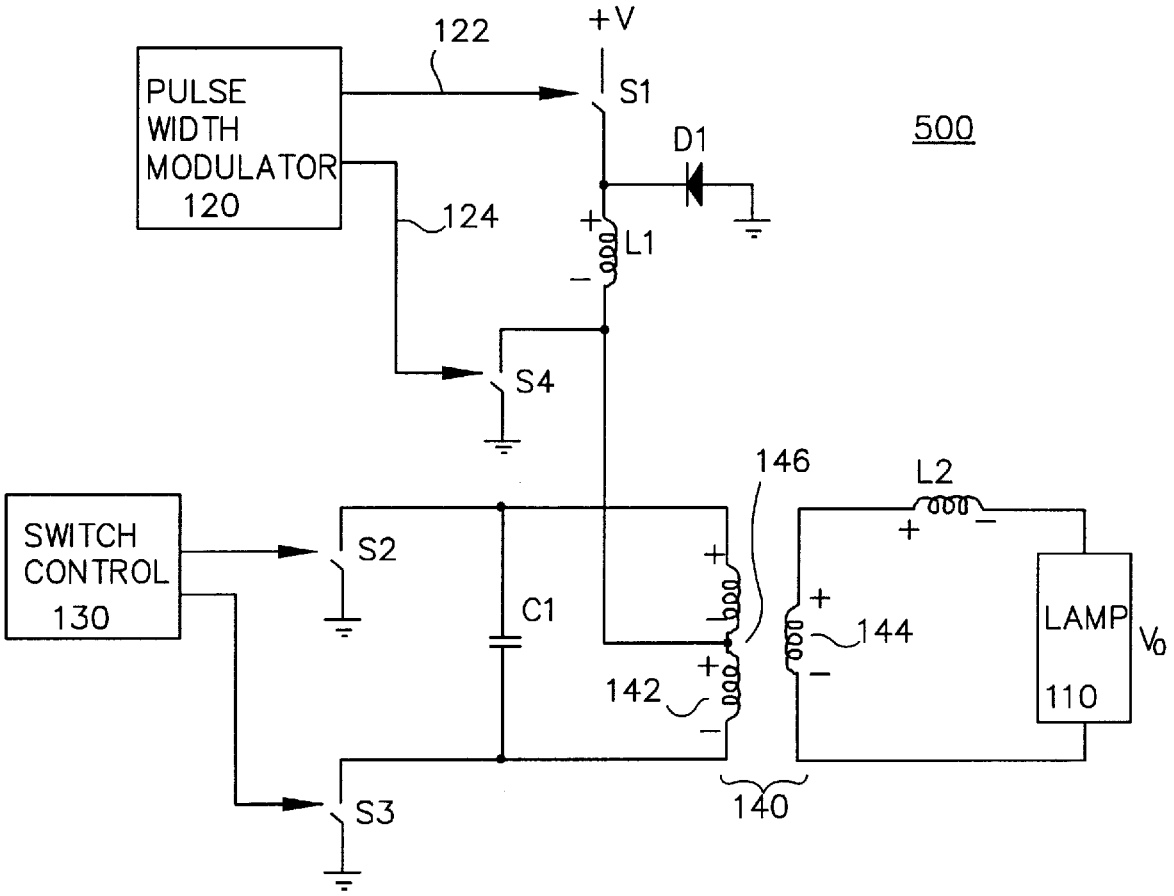
FIG. 5 is a simplified schematic diagram of an embodiment of the current-fed resonant lamp inverter 500 in accordance with the present invention.

Referring to FIG. 5, there is shown a simplified schematic diagram of an embodiment 500 of the present invention. The discussion above with respect to the components shown in FIG. 1 apply with respect to the components shown in FIG. 5. Those skilled in the art will recognize that there exist many variations that can be incorporated into the present invention and accomplish the purpose of directing stored energy to ground. In the embodiment 500 shown in FIG. 5, switch S4 is added to the inverter 100 of FIG. 1 to obtain an increased dimming ratio by discharging energy stored in the inverter's reactive components to ground. PWM 120 provides output 124 to modulate switch S4 while it provides output 122 to modulate switch S1. The PWM 120 operates either at a fixed or variable frequency. Also, PWM 120 can be synchronized with the video (image) signals flowing to the LCD (not shown). The on/off state of switch S4 is opposite that of switch S1, i.e., when switch S1 is open switch S4 is closed and vice versa. Switch S4 is open when power is applied to the inverter 500 (by closing switch S1) to supply power to the lamp 110. Conversely, switch S4 is closed when power is removed from the inverter 500 by opening switch S1. Because switches S2 and S3 are alternated between open and close as discussed above, either switch S2 or S3 remains closed when switch S4 is closed. The closing of switch S4, in conjunction with the closing of either switch S2 or S3, creates a short across capacitor C1 and the primary windings 142 of the transformer 140 and diverts the stored energy to ground. The closing of switch S4 also diverts the current flowing through inductor L1 into ground. Thus, instead of producing light in lamp 110 (as is the case demonstrated in FIGS. 3–4), the energy stored by the reactive components in the inverter 500 is harmlessly dissipated by switch S4 into ground. Consequently, the voltage across the lamp 110 decreases to zero volts much faster than if using the inverter 100 (see FIGS. 6 and 7). The inverter 500 of the present invention results in a factor of 10 improvement over the dimming capability of inverter 100, which represents a dimming ratio of 10,000:1 for inverter 500.

Switch S4 can be positioned in several locations in inverter 500 as will be recognized by those skilled in the art; the location of switch S4 as shown in FIG. 5 is for convenience in introducing the present invention and not by way of limitation. For example, instead of the location of switch S4 illustrated in FIG. 5, switch S4 can be operatively connected across either the primary 142 or secondary 144 windings of the transformer 140 or across the lamp 110. If the switch S4 is positioned to discharge energy from the secondary windings 144 or the lamp 110, then a switch that is rated for the high voltage on the secondary side of the transformer would be required. Also, the same result can be achieved, i.e., harmless dissipation of energy to ground, without adding the additional switch S4 by switching both switches S2 and S3 to an on state (closed) at the same time. The reactive components can be discharged to ground by turning both switches S2 and S3 on at the same time. Typically, those skilled in the art would open both switches S2 and S3 at the same time to remove power from the lamp 110 (as discussed above), from which the present invention teaches away. The present invention teaches away from conventional practice in this regard; conventional applications desire to open switches S2 and S3 at the same time to turn the inverter to an off state to dim the lamp 110.

There are many variations that can be implemented in inverter 500, which include, but are not limited to, using bipolar transistors or field-effect transistors ("FETs") in place of the switches S1, S2, and S3. Switch S1 can be omitted (or closed at all times) if a continuous source of power is desired depending on the application. A capacitor can be used in place of inductor L2. Additionally, there are many variations that can be used to synchronize switches S2 and S3 with the resonant frequency of the reactive components shown in the inverter 100. A feedback winding from the transformer 140 can be used to turn transistors on and off at the resonant frequency. Also, analog comparator circuits can be used to detect the resonant frequency of the circuit by monitoring the voltage at a particular node such as the transformer centertap 146. The present invention is applicable to either a cold cathode fluorescent lamp or a hot cathode fluorescent lamp. A hot cathode lamp requires additional circuitry to drive the lamp filaments as will be recognized by those skilled in the art. Additionally, many other types of lamps, such as neon lamps, can be dimmed with the present invention. Those skilled in the art that other variations can be employed without departing from the principles of the present invention.

Figure 6:
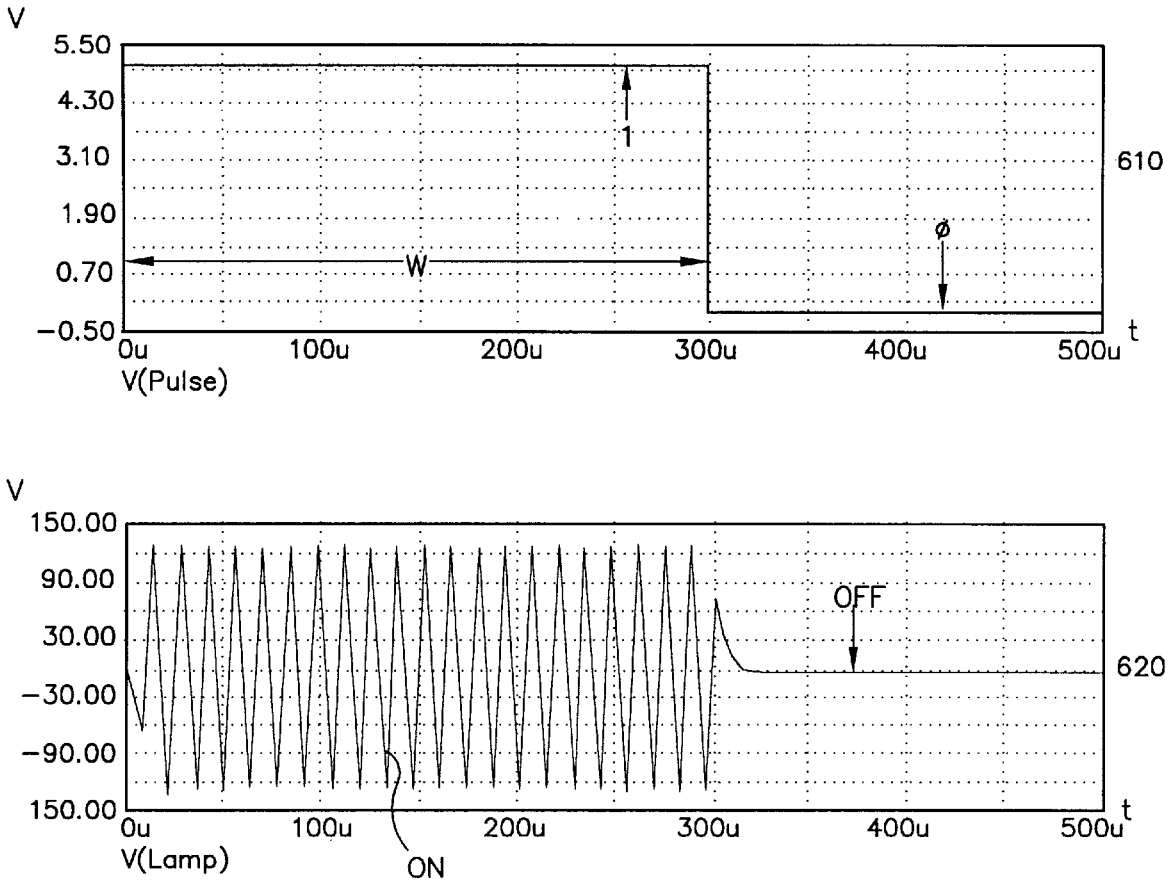
FIG. 6 is a graph of the turn-off characteristics of the inverter 500 of FIG. 5, voltage versus time (in micro-seconds), in accordance with the present invention.

Referring to FIG. 6, there is shown a graph of the turn-off characteristics of the inverter 500 shown in FIG. 5. As can be seen upon comparison of FIGS. 3 and 4 with FIG. 6, there is significantly less oscillation around zero volts resulting from the embodiment shown in FIG. 5. When power is removed from the inverter 500, the output voltage falls to zero volts almost immediately (e.g., 50 micro-seconds) as can be seen from FIG. 6, waveform 620. Although the reactive components store energy that discharge into the lamp 110 for a short time after power is removed, the embodiment 500 significantly reduces the time required to decrease $V_O$ to zero volts, representing complete turn-off, which is a highly-desirable feature in a dimming device for fluorescent lamps and has not been recognized until the present invention despite the myriad dimming circuits that are intended but not available for this purpose.

Figure 7:
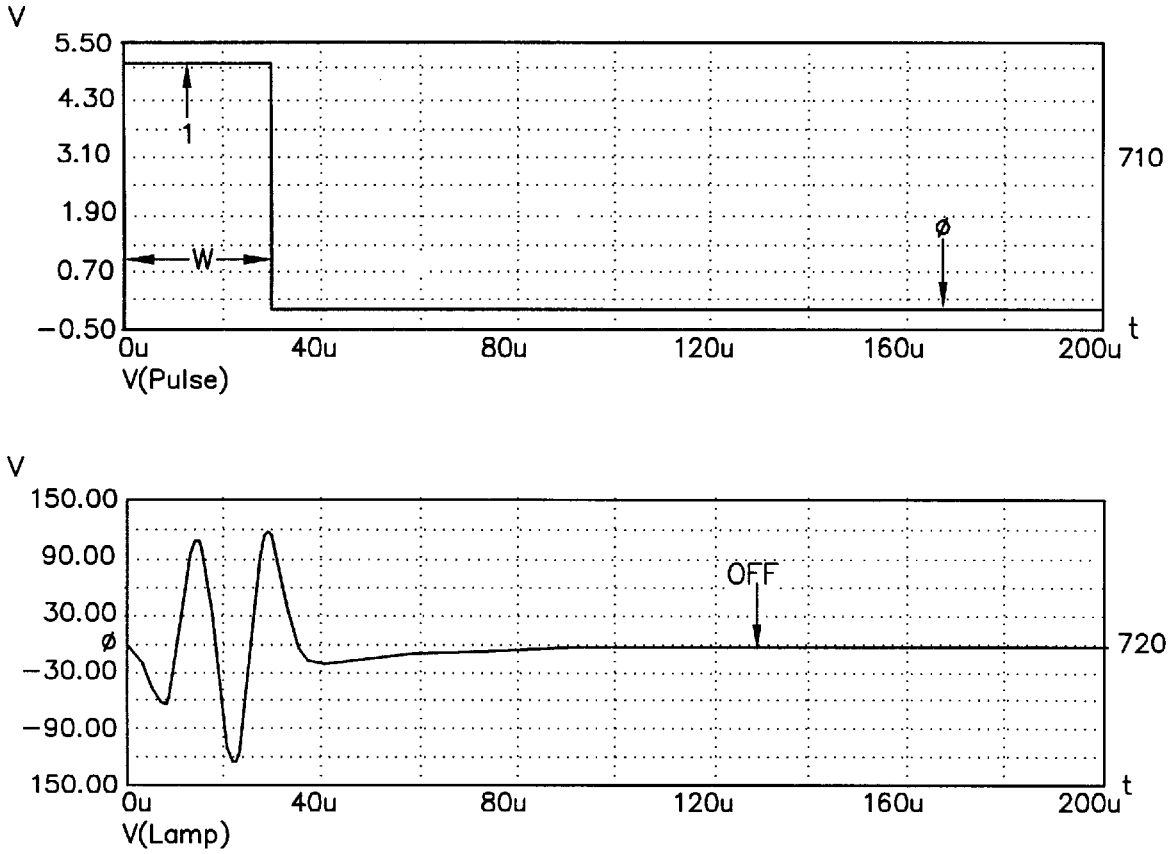
FIG. 7 is a graph of a short duration pulse applied to the lamp and the corresponding turn-off characteristics of the inverter 500 of FIG. 5, voltage versus time (in micro-seconds), in accordance with the present invention.
Figure 8:
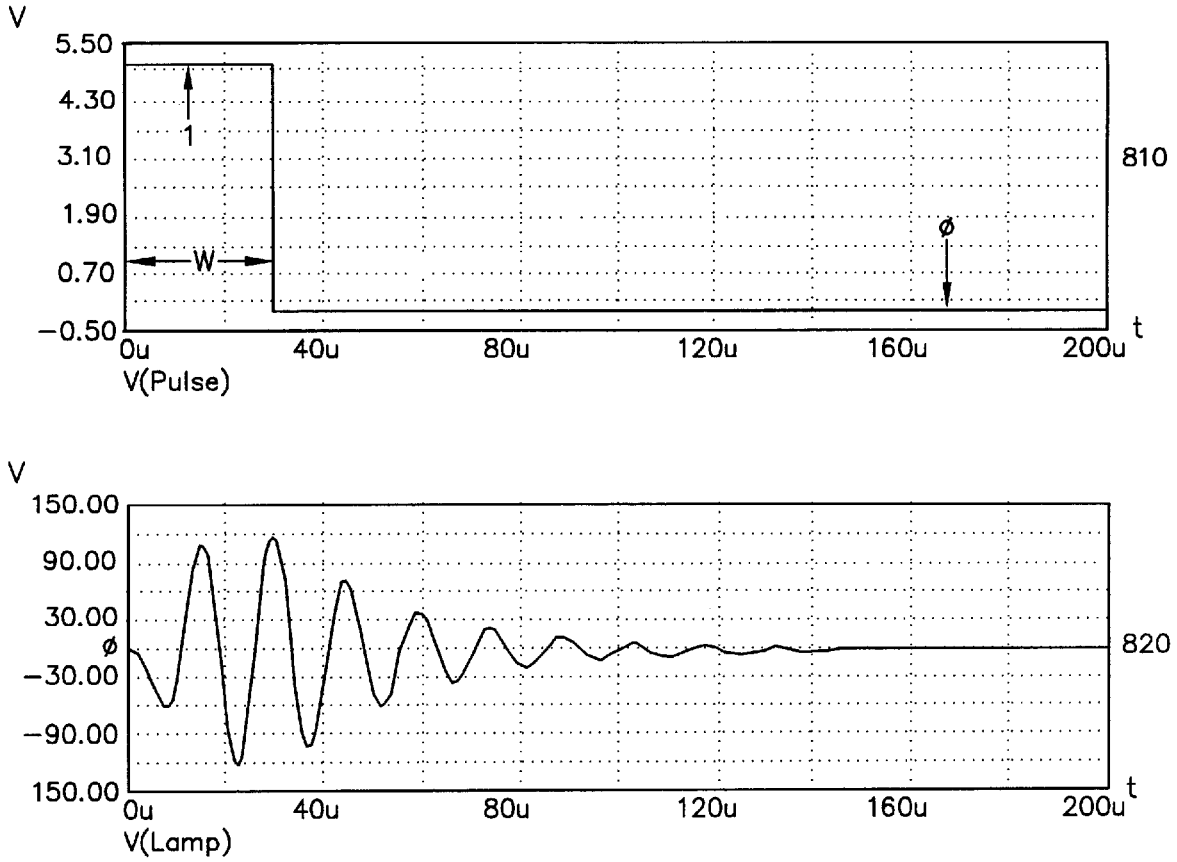
Fig. 8 (PRIOR ART)
FIG. 8 (prior art) is a graph of a short duration pulse applied to the lamp and the corresponding turn-off characteristics of the inverter 100 of FIG. 1, voltage versus time (in micro-seconds).

It is important to note that power has to be applied to the inverter 500 for at least one full period in order for the lamp 110 to be illuminated, i.e., a high enough arc voltage to strike an arc in the lamp 110, which is dependent upon the lamp parameters. For example, some lamps can require about 40V while other lamps can require about 200V to operate. Referring to FIG. 7, there is shown a graph of a short duration pulse applied to the lamp and the corresponding turn-off characteristics of the inverter 500 of FIG. 5, voltage versus time (in micro-seconds), in accordance with the present invention. The example of FIG. 7 shows a waveform 710 demonstrating that when the PWM 120 output is a logic 1 for 30-s, the inverter 500 is active so that the lamp 110 produces light. When the PWM 120 output is a logic 0, the inverter 100 is not active so that the lamp 110 does not produce light. As can be seen from lower trace 720, the lamp can be powered almost completely off within a matter of micro-seconds. Referring to FIG. 8 there is shown a graph of a short duration pulse applied to the lamp and the corresponding turn-off characteristics of the inverter 100 of FIG. 1, voltage versus time (in micro-seconds). FIG. 8 represents the turn on and off characteristics for inverter 100. As can be seen from the waveforms 810 and 820 of FIG. 8, the same voltage is applied to the inverter 100 as that applied to inverter 500 with significantly different results. The waveform 820 illustrates that the lamp 110 still produces light for a considerable amount of time after the power is removed (logic 0 in waveform 810); for an equal duty cycle, the light producing power applied by inverter 500 is much lower than that of inverter 100.

The particular values and configurations discussed in this non-limiting disclosure can be varied and are cited merely to illustrate an embodiment of the present invention and are not intended to limit the scope of the invention. Other variations and modifications of the present invention will be apparent to those of skill in the art, and it is the intent of the appended claims that such variations and modifications be covered. For example, the switching means to discharge the energy stored in reactive components can be used in a voltage-fed inverter rather than a current-fed inverter. The particular values and configurations discussed above can be varied and are cited merely to illustrate a particular embodiment of the present invention and are not intended to limit the scope of the invention. It is contemplated that the use of the present invention can involve components having different characteristics as long as the principle, the presentation of a lamp dimming device and method by harmless dissipating the energy stored in reactive components in the dimming circuit to ground, is followed. It is intended that the scope of the present invention be defined by the claims appended hereto.

The embodiments of an invention in which an exclusive property or right is claimed are defined as follows:

1. An apparatus for dimming the brightness of at least one lamp, the apparatus comprising:

a power supply that supplies direct-current power, the power supply being referenced to ground; and an inverter, operatively connectable to said power supply, for driving the lamp, the inverter comprising:

first switching means for creating alternating-current power from the direct-current power;

power conversion means, operatively connectable to said first switching means, for providing and maintaining an arc voltage across the lamp;

modulating means, operatively connectable to said power conversion means, for modulating the alternating-current power to control and vary the alternating-current power across the lamp between zero volts and the arc voltage;

a plurality of reactive components operatively connectable to the power conversion means, said plurality of reactive components storing energy provided by said power supply; and second switching means, operatively connectable to said plurality of reactive components, for switching the lamp between an on and an off state, said second switching means being positioned in the inverter such that energy stored in said plurality of reactive components is discharged to ground when the lamp is switched to the off state.

2. The apparatus of claim 1, wherein said plurality of reactive components comprises a first reactive component, operatively connectable to the lamp and to said power conversion means, for controlling the alternating-current power across the lamp.

3. The apparatus of claim 2, wherein said plurality of reactive components comprises, a second reactive component, operatively connectable to said power supply and said power conversion means, for controlling the direct-current power supplied by said power supply.

4. The apparatus of claim 1, wherein said modulating means reduces the alternating-current power across the lamp for a period of time sufficient to cause the voltage across the lamp to equal zero.

5. The apparatus of claim 1 further comprising a third switching means, operatively connectable to said power supply and said inverter, for allowing and disallowing the direct-current power from being received by the inverter.

6. The apparatus of claim 5, wherein said modulating means is a pulse width modulator, operatively connectable to said third switching means, that generates pulses on a periodic basis at a predetermined frequency to modulate the direct-current power, wherein the pulses have a width that is controlled by the magnitude of the direct-current power supplied by said power supply.

7. The apparatus of claim 6, wherein the lamp is dimmed in response to a decrease in the width of the pulses and brightened in response to an increase in the width of the pulses.

8. The apparatus of claim 5, wherein said modulating means modulates said second switching means while said modulating means also modulates said third switching means.

9. The apparatus of claim 8, wherein said modulating means modulates said second switching means and said third switching means in an alternate fashion between two different states.

10. The apparatus of claim 1, wherein said power conversion means is a transformer, the transformer having primary windings with a centertap, wherein the direct-current power flows from said power supply to the centertap.

11. The apparatus of claim 10, wherein said second switching means creates alternating-current power across the primary windings of the transformer.

12. The apparatus of claim 1, wherein the inverter provides a brightness dimming ratio of approximately 10,000:1.

13. An apparatus for dimming the brightness of at least one lamp, the apparatus comprising:

a power supply that supplies direct-current power, the power supply being referenced to ground; and an inverter, operatively connectable to said power supply, for driving the lamp, the inverter comprising;

switching means for creating alternating-current power from the direct-current power and for switching the lamp between an on and an off state;

power conversion means, operatively connectable to said switching means, for providing and maintaining an arc voltage across the lamp;

modulating means, operatively connectable to said power conversion means, for modulating the alternating-current power to vary the alternating-current power across the lamp between zero volts and the arc voltage; and a plurality of reactive components operatively connectable to the power conversion means, said plurality of reactive components storing energy provided by said power supply; and wherein said switching means is configured in the inverter such that energy stored in said plurality of reactive components is discharged to ground when the lamp is switched to the off state.

14. The apparatus of claim 13, wherein the inverter provides a brightness dimming ratio of approximately 10,000:1.

15. A method of dimming the brightness of at least one lamp, the method comprising the steps of:

providing a power supply that supplies direct-current power, the power supply being referenced to ground; and providing an inverter to drive the lamp, the inverter comprising a plurality of reactive components that store energy provided by the power supply, the step of providing an inverter comprising the steps of:

converting the direct-current power to alternating-current power;

providing and maintaining an arc voltage across the lamp;

modulating the alternating-current power to control and vary the alternating-current power across the lamp between zero volts and the arc voltage; and switching the lamp between an on and an off state through the use of switching means that are positioned in the inverter such that energy stored in the plurality of reactive components is discharged to ground when switched to the off state.

16. The method of claim 15, wherein the step of modulating includes the step of reducing the alternating-current power across the lamp for a period of time sufficient to cause the voltage across the lamp to equal zero.

* * * * *